United States Patent [19]

Kuehnle

[11] 4,133,906

[45] Jan. 9, 1979

[54] METHOD OF TONING AN ELECTROPHOTOGRAPHIC FILM

[75] Inventor: Manfred R. Kuehnle, Lexington, Mass.

[73] Assignee: Coulter Systems Corporation, Bedford, Mass.

[21] Appl. No.: 544,321

[22] Filed: Jan. 27, 1975

Related U.S. Application Data

[62] Division of Ser. No. 323,108, Jan. 12, 1973, Pat. No. 3,878,817.

[51] Int. Cl.[2] ..... G03G 13/10

[52] U.S. Cl. ..... 427/17; 96/1 LY; 118/650; 118/659; 427/429

[58] Field of Search ..... 427/15, 17, 16, 429; 118/637, DIG. 23, 264, 265; 96/1 LY; 222/187, 213, 214; 112/650, 659, 662

[56] References Cited

U.S. PATENT DOCUMENTS

| | | | |
|---|---|---|---|
| 2,987,955 | 6/1961 | Sassenberg | 118/267 |
| 3,096,198 | 7/1963 | Schaffert | 118/637 X |
| 3,133,484 | 5/1964 | Wright | 118/637 X |
| 3,343,956 | 9/1967 | Wright | 118/637 X |
| 3,461,843 | 8/1969 | Noon | 118/DIG. 23 X |
| 3,472,676 | 10/1969 | Cassiers et al. | 118/637 X |
| 3,545,997 | 12/1970 | Hochberg | 427/195 X |
| 3,618,567 | 11/1971 | Levy | 427/15 X |
| 3,635,195 | 1/1972 | Levy | 427/15 X |
| 3,683,852 | 8/1972 | Yamaguchi et al. | 427/15 X |
| 3,727,578 | 4/1973 | Saito et al. | 427/15 X |
| 3,795,351 | 3/1974 | Lehmann | 222/209 |

*Primary Examiner*—Ronald H. Smith
*Assistant Examiner*—Stuart D. Frenkel
*Attorney, Agent, or Firm*—Silverman, Cass & Singer, Ltd.

[57] ABSTRACT

A method of toning the latent image carried by the photoconductive surface of an electrophotographic film in which a liquid suspension of toner particles is flowed or streamed substantially simultaneously uniformly against said surface over all said surface in a direction normal thereto from a source spaced from the surface and the excess or remanent toner suspension is removed from the surface thereafter without displacing said source or moving the film.

The toner particles are biased with a d.c. bias voltage of a polarity the same as the electrophoretic surface charge of the toner particles to enhance particle movement toward the photoconductive surface.

6 Claims, 6 Drawing Figures

METHOD OF TONING AN ELECTROPHOTOGRAPHIC FILM

This is a division of application Ser. No. 323,108 filed Jan. 12, 1973, now U.S. Pat. No. 3,878,817.

CROSS-REFERENCE TO RELATED APPLICATIONS

Reference is made herein to a copending patent application Ser. No. 260,848, filed June 8, 1972 and entitled "ELECTRO-PHOTOGRAPHIC FILM" and to a copending continuation-in-part patent application of said first-mentioned case, Ser. No. 323,132, filed Jan. 12, 1973 and entitled "ELECTROPHOTOGRAPHIC FILM AND METHOD OF MAKING AND USING THE SAME," both of said copending applications being assigned to the assignee of this application.

The above-identified applications have been abandoned in favor of later filed continuations-in-part, the last of which is copending and identified by Ser. No. 434,699, filed Jan. 18, 1974 and entitled, "ELECTROPHOTOGRAPHIC FILM, METHOD OF MAKING AND USING THE SAME AND PHOTOCONDUCTIVE COATING USED THEREWITH."

BACKGROUND OF THE INVENTION

This invention relates generally to the processing of electrostatic images and more particularly is concerned with applying toner particles to such images.

In the field of xerographic or electrostatic image recording, a latent image is formed on a plate or other member. This latent image is the pattern which is projected onto the member by a lens system or the like. Prior to the projection, the member is charged by corona thereby providing a large number of electrons at or near the photoconductive surface which are capable of migrating when struck by photons. The projection or exposure, as it may be termed, causes electrons to leave the surface, in proportion to the amount of impinging light at any increment of the surface. The latent image is thus formed of electrons and the absence of electrons.

The charge originally placed on the photoconductive surface will decay in time and with it the latent image will fade. The image is made visible, according to the art, by the application of toner particles thereto, these particles having electrostatic charges which cause them to adhere to the electrons on the photoconductive surface of the member. In this manner the image is formed on the member. Toner particles are minute particles of carbon, resins and the like.

In most xerographic equipment, the member to which the particles adhere comprises a selenium drum and the drum is pressed against a sheet of paper to transfer the image to the paper. Then the paper surface carrying the toner particles is rapidly heated causing the particles to fuse permanently to the paper. In other apparatus the latent image is formed directly on the sheet of paper which has been coated with a zinc oxide-resin mixture that is photoconductive. This process is known as electrofax, and the toner is applied in liquid form, the liquid normally being a hydrocarbon within which the toner particles will achieve surface charge. The xerographic process using a drum utilizes a type of toning known as cascade toning in which the toner particles are mixed with plastic beads and applied in this dry mixture form. Only the toner particles adhere to the selenium surface of the drum, this being the photoconductive surface.

The invention was developed for use with electrostatic image apparatus of a nature that differs from those mentioned above, primarily in that the construction of the member carrying the latent image is different, giving rise to many advantages. Principally, the speed of the photoconductive surface is so great and its sensitivity so high that the member can be used much in the same manner as the ordinary photographic cameras, but without many of the disadvantages thereof. The member itself comprises a structure that can be called an electrophotographic film, comprising a substrate of polyester or the like carrying an ohmic layer bonded thereto and an inorganic photoconductive coating bonded to the surface of the ohmic layer. Reference may be made to the copending patent applications for detailed descriptions of said electrophotographic film.

This electrophotographic film has a very high dark decay characteristic and a large differential between dark and light decay characteristics. Its photoconductive surface can be charged very quickly—in a matter of a fraction of a second—and exposed at rates comparable with those used to expose high speed silver halide emulsion photographic films. The primary manner of use of the electrophotographic film of said copending applications is to produce transparencies, since the combination of the ohmic layer and the photoconductive coating on the clear plastic substrate will provide an extremely thin lamination which is transparent to a substantial degree—between about 70 percent and 85 percent. Accordingly, in forming the visible image, it is desired to apply toner to the photoconductive surface and thereafter to fuse the toner particles directly to the lamination itself.

Due to these desires and the characteristics of the electrophotographic film, it is essential that the toning of the member be done as rapidly as possible after exposure has occurred. This, of course, is to prevent the decay of the latent image along with the decay of the charge on the photoconductive member. The apparatus and method of the invention were designed for and are especially adapted for such utilization, but are not so limited. The teachings of the invention are applicable in other techniques and with other apparatus as well.

Aside from the requirements of the high speed electrophotographic film which has been mentioned above, all of which are met by the invention, many disadvantages of prior methods and apparatus for toning have been obviated. These disadvantages which are mentioned hereinafter are caused by the nature of the xerographic or electrofax process to some extent, but the methods and apparatus for toning are a considerable factor as well.

Where baths are used, as in electrofax, the images which are produced are inherently nonuniform because the sheet of paper carrying the photoconductive surface is immersed into the bath from one edge and passes progressively through to the other. The decay of the image and surface charge is still going on while this occurs so that there is bound to be fading from the leading to the trailing edge. In the case of the high speed electrophotographic film of the copending applications the fading would be aggravated in a bath-type of toning process. The apparatus and method of the invention provide for application of the toner suspension simultaneously over the entire photoconductive surface of the electrophotographic film.

Another problem with prior methods and apparatus is fidelity or tone, in the popular sense, of the resulting image. Where an exposure is proper with respect to a given set of conditions, some time later, after the bath of toner in liquid has been used for a while, the toner becomes depleted. The concentration of toner particles changes and the image resulting loses contrast and depth.

As will be understood from the description of the invention the method and apparatus call for the toner suspension to be accurately and precisely prepared in advance, encapsulated in a suitable enclosure, used in one instance and the remainder discarded. In this way, total uniformity is achieved every time. Exposure can always be precisely related to the toner concentration by the manufacture and can be relied upon to obtain optimum results for each use.

In prior apparatus toner application has produced bad grey scales and nonuniform black areas. The xerographic equipment in use at the present time cannot produce images with large uniform dark areas. This is known as edge effect. Such areas come out light in the center and dark along the edges, this being caused by the tendency of the toner particles to seek the maximum field differential thereby migrating to the edges of the images. According to the invention, this is obviated by a novel biasing method and apparatus which will be described, the resulting images being uniform in color and having excellent grey scale characteristics.

Electrostatic image producing apparatus which utilize dry toner application in the processing of the photoconductive surfaces of the members used have problems of uniformity, waste, and difficulties in handling. There are mixtures of plastic beads and iron filings which have to be handled, separated, and the foreign particles and surplussage discarded. Often, where dry foreign particles are included in the mixtures, the application of toner is inefficient because of adherence to the foreign particles. Other structures use magnetic brushes to provide the necessary surface charge to the toner particles, this being more apparatus to handle and keep clean.

Given the necessity of building a small hand-held camera type of device for producing the electrostatic record, prior methods of processing require apparatus which is complex, bulky and expensive. It is unlikely that such a device could be manufactured with the known technology represented by such prior methods and apparatus. The invention herein, on the other hand, makes such a project feasible and practical.

In electrostatic image producing apparatus known, the fields represented by the latent images on the photoconductive surfaces are relatively weak. Furthermore, their strength decreases with distance from the surface by exponential factors so that the attraction for toner particles is not very great. Accordingly, such apparatus depends in some instances importantly on gravity to bring the particles within the stronger portions of the fields close to the surfaces comprising the photoresponsive layers, and in other instances the toner is mechanically agitated to throw the particles into such fields. Two adverse results are nonuniformity and time loss. Surfaces which are not horizontally disposed with the toner applied on the upper side suffer to some greater extent from these two problems.

The bias used in accordance with the invention drives the particles directly at the photoconductive surface and thus obviates the above-described disadvantages. Specifically, besides uniformity, the processing or timing is accomplished substantially instantaneously and irrespective of the disposition of the photoconductive surface.

A large measure of difficulty with prior apparatus is additionally eliminated by providing disposable capsules of toner which are economical and easy to use, besides giving uniform results.

Many advantages which are not specifically described above are inherent in the invention and these will become apparent from the description which follows.

SUMMARY OF THE INVENTION

The invention herein is characterized by the provision of a capsule having a relatively rigid foraminous wall and flexible side walls, an interior spongelike member and the interior being filled with toner suspended in a toner liquid. The combination of walls and spongelike member are constructed so that the capsule is capable of being compressed or squeezed or collapsed and thereafter will recover. The foraminous wall has an exterior conductive coating adapted to be connected to a d.c. potential source of polarity the same as the surface charge of the toner particles.

The capsule is used by bringing the exterior of the foraminous wall into parallel and spaced juxtaposition to the photoconductive surface of an electrophotographic film, the capsule and film framing member being engaged to provide a confining chamber. The capsule is then squeezed so that the toner suspension is pressed out of the perforations of the foraminous wall simultaneously over the entire photoconductive surface and confined within said chamber. When the capsule is released, it returns to its original configuration and sucks the remaining liquid and toner back into the capsule which can then be discarded. The latent image has toner particles now adhered thereto and these may be fused to the film when desired.

The bias serves to drive the toner particles in suspension directly from the perforations and against the photoconductive surface normal thereto thereby eliminating edge effect.

Apparatus for using the capsule includes means for squeezing the same and releasing the same while it is in engagement with the film.

The images resulting from the use of the capsule are clean, uniform, with excellent grey scales and with large dark areas having continuous tonal range.

DESCRIPTION OF PREFERRED EMBODIMENTS

Generally the invention herein enables practically instantaneous processing, that is, application of toner to electrophotographic film. This is advantageous generally for apparatus which produce electrostatic images and particularly is advantageous when used with the type of electrophotographic film that is disclosed in the copending applications mentioned hereinabove.

According to the invention, the toner particles in a liquid suspension are carried in a capsule which may be sealed by a suitable removable member for storage purposes. When ready for use the removable member is peeled from a foraminous surface and the capsule positioned adjacent the exposed photoconductive surface of the electrophotographic film, the juxtaposed articles having engaging surfaces forming an enclosed chamber. The capsule is squeezed, driving the toner directly to the photoconductive surface over its entire area simultaneously. An electric bias enhances the movement of toner particles to all areas simultaneously.

After the toner has adhered to the latent image the capsule is released and the remaining suspension is sucked back into the capsule which is discarded. The moist image quickly dries, and if satisfactory, may be fused to the film by the operator.

Figure 1:
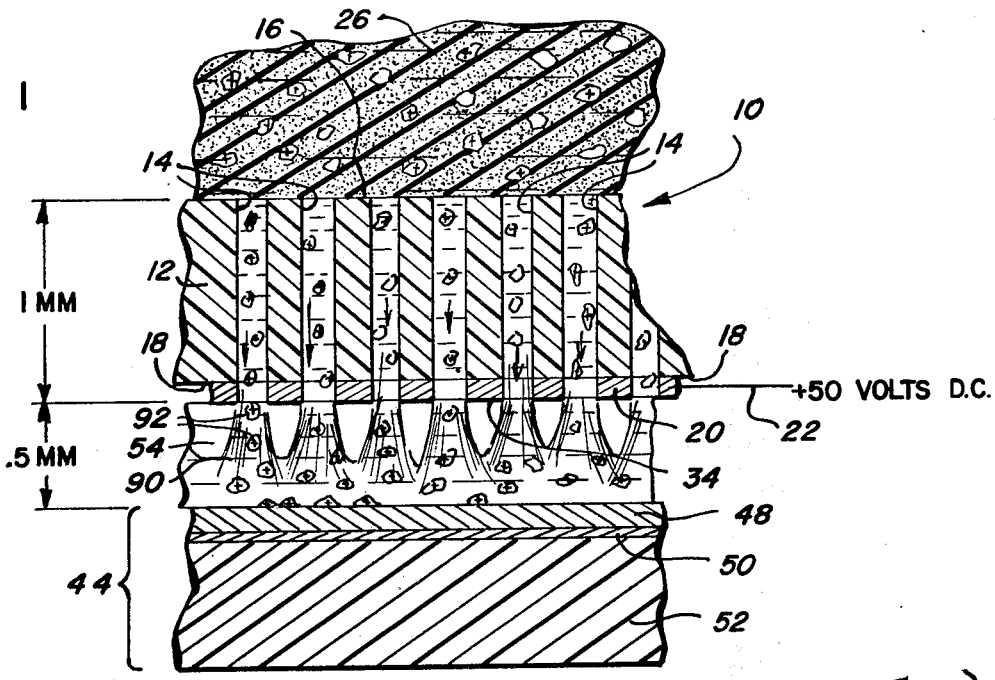
FIG. 1 is a fragmentary sectional view taken through the processing apparatus of the invention showing the manner in which toner suspension is applied to the photoconductive surface of an electrophotographic film.

FIG. 1 illustrates a fragmentary section through a capsule shown in juxtaposition to an electrophotographic film in an exaggerated dimensional form. The capsule itself is shown completely in FIGS. 2 and 3. Reference may first be had to these three figures for the initial explanation.

The capsule 10 of the invention comprises a planar rectangular wall 12 which is described herein as foraminous. It is provided with a large number of tiny perforations or passageways 14 which pass through the wall 12 transversely thereof, from the inner surface 16 to the outer surface of the wall which is designated 18. The said outer surface 18 is coated with a thin coating or layer 20 of conductive materials such as aluminum. The wall 12 may be formed of rigid polyvinyl chloride or other relatively rigid insulating material that has the necessary characteristics. A thickness of about one milimeter will be sufficient. The wall 12 is required to be of insulating material, capable of being perforated to produce very fine pores—say of the order of 50 microns in diameter. It should be impervious to the chemicals which are used. In the present structure, the toner suspension which is used is a liquid hydrocarbon comprising a turpentinelike substance known as isopar. Due to the nature of the invention, since, as will be seen, the suspension is always encapsulated until it is used, the liquid used to suspend the toner particles can be freon or other much more volatile fluids.

The perforations 14 continue through the metallic coating 20. This coating is quite thin compared with the wall 12 and in use is connected to a potential source by a suitable conductor 22. As shown in FIG. 1, the potential is positive 50 volts d.c. it being assumed that the surface charge on the toner particles in the capsule will also be positive. This will be explained below.

Above the wall 12 as shown in FIG. 1 there is provided a rectangular mass of some resilient absorbent material, such as for example any of the manmade commonly available sponges on the market today. This mass is shown at 26 and may be in the form of an integral member or a granular mass. The only requirements of the mass 26 are that it be resilient to enable its recovery when squeezed and released; that it have good capillary qualities to hold and release the toner suspension; and that it be chemically impervious to the toner liquid.

The remaining walls 28 of the capsule 10 are formed of a thin flexible skin, for example molded or vacuum-formed polyvinyl chloride, impervious to the liquid used to suspend the toner particles. The walls will have an outwardly extending border 30 which is heat-sealed or otherwise welded to the surface 16 around its periphery. The wall 12 conveniently can be perforated all over so that the sealing of the enclosing walls 28 thereto will block off a framing portion 32 surrounding the central perforated portion 34. Obviously, the member forming the wall 12 could be stamped out of a larger perforated sheet or could be formed from a sheet member that has only the center section 34 perforated. In any event, the capsule 10 has the framing border 32 surrounding the central perforated area 34 and extending laterally outward of the rectangular body enclosed by the walls 28.

As stated above, the sponge member or mass 26 has toner particles in a liquid suspension saturating the same. The perforated area 34 is preferably closed off against entry of air or loss of suspension by means of a removable member 36 of paper or the like having a tab 38 for grasping the member 36. This member may be of paper adhered with pressure-sensitive adhesive that is not soluble in the liquid used to make the suspension of toner. Actually, the perforations 14 are so small that it is not likely that much liquid will come through the same and contact the adhesive which is shown at 40. This arrangement enables the capsule to be stored and handled without loss of toner suspension and provides a surface for carrying printed instructions, expiration time, etc.

As pointed out, the outer surface of the wall 12 is coated with a very thin layer 20 of aluminum or the like metal to enable a bias to be applied to this layer. The capsule 10 may have a contact tab or extension 41 connected to the metal layer 20 to enable the bias to be applied when the capsule is in position for use. This will be explained in connection with FIG. 2. Instead of this arrangement, contact means may be provided for contacting any other part of the surface 20 when the capsule is in position.

Figure 2:
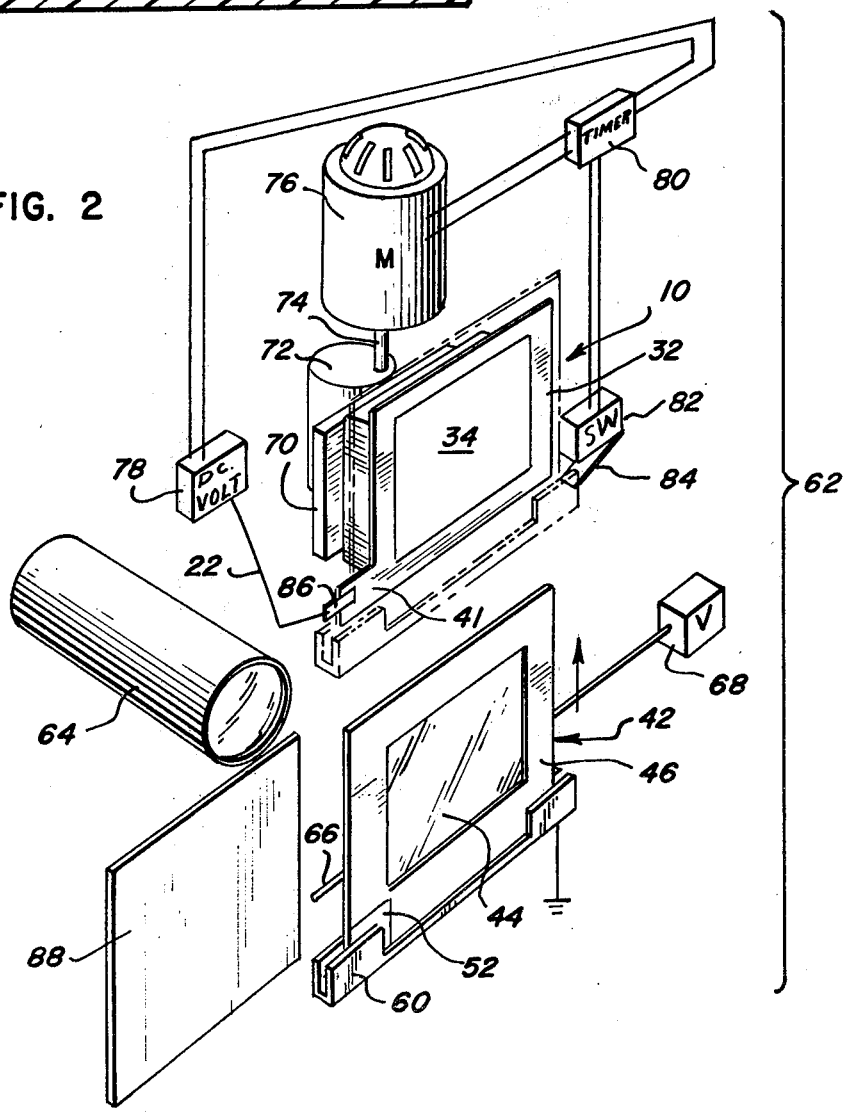
FIG. 2 is a schematic view illustrating the manner in which the appratus is associated with an electrostatic image producing device, showing additional details of the apparatus and related components.
Figure 3:
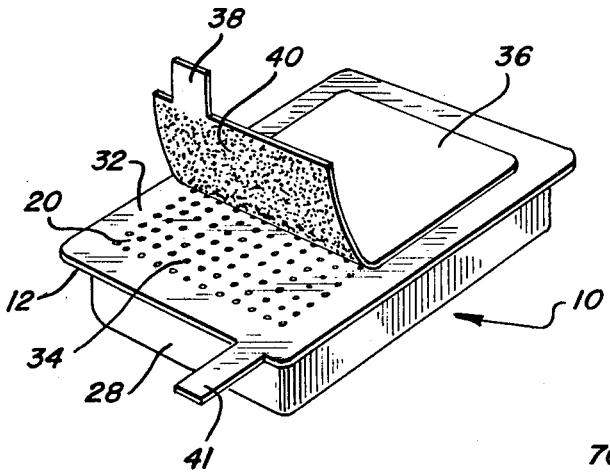
FIG. 3 is a perspective view of a capsule of toner constructed in accordance with the invention, showing the manner in which a pressure sensitive storage member is removed from the capsule to enable the capsule to be used immediately.

The capsule 10 is used by inserting the same into the electrostatic image producing apparatus in juxtaposition to the member carrying the latent image. FIG. 2 shows one such arrangement and also illustrates some of the other components of a device for recording images. This could be a stationary apparatus, a hand-held cameralike device, etc.

At the bottom of the view there is illustrated a recording member 42 which comprises a central rectangular transparent portion 44 and a framing border 46. The border 46 may be made of any suitable material such as for example molded plastic and the transparent portion comprises the electrophotographic film such as for example, the type of article which is disclosed in the copending applications. As understood from the said copending applications, there is a photoconductive coating 48 of an inorganic photoconductive compound, an ohmic or conductive layer 50, also inorganic and a substrate member 52 of an insulating plastic such as an organic polymer. The total thickness of the two inorganic layers 48 and 50 is less than 5000 Angstroms and the substrate member is of the order of fraction of a millimeter in thickness. Since the member 42 will be used as a transparency, the framing border 46 is preferably slightly thicker than the entire film 44 so that said film is slightly spaced inwardly of the framing border front and back. Thus, if the perforated section 34 of the capsule 10 is placed flush against the surface of the member 42 and aligned with the film 44, the framing border 32 will be pressed against and congruent with the framing border 46 and the photoconductive coating 48 will have its surface spaced from the surface 34 by about 0.5 millimeter, depending upon the thickness of the framing border 46.

Preferably the electrophotographic film 44 is molded into the framing border 46 of the member 42 so that the thickness is accurately controlled. The ohmic layer 50 is required to be grounded when the surface is charged and exposed. Thus there may be an internal conductor 50 along one edge of the film 44 which is connected with an external contact 52 provided adjacent a lateral edge of the member 42 as shown.

When the capsule wall 12 and the member 42 are pressed into engagement with one another, the space between the surface 34 and the surface of the photoconductive coating 48 forms a closed rectangular chamber 54 which is dammed or closed off, at least insofar as liquid flow is concerned, by the inner edges 56 of the framing border 46. This chamber 54 is filled with toner suspension during the processing of the film 44.

In FIG. 2, the member 42 is shown mounted in a vertically movable carrier 60 which is grounded in the electrostatic recording apparatus designated generally 62. The frames and housings and considerable auxiliary apparatus and components are not shown here since they are not essential to the explanation. The contact 52 of the member 42 engages the carrier to ground the ohmic layer 50 of the film 44.

An optical system including lenses and the like is symbolically indicated at 64 for focussing an image on the photoconductive surface of the film 44. A corona wire 66 is disposed quite close to the surface of the coating 48 but out of focus with respect to the optical system 64, said wire 66 being connected to a source of high voltage shown at 68. Spaced above the position of the member 42 during exposure is the mounting (not shown) for the removable capsule 10. When in place, as shown, there is a pressure pad 70 of rigid material such as metal or some resin just to the rear of the capsule 10, considering the wall 12 as its front. The pressure pad 70 could be just touching the rear wall 28 if desired. An eccentric cam 72 engages the rear surface of the pressure pad 70 and is mounted for rotation with a shaft 74 that is driven by a motor 76. The motor 76 is adapted to be energized from an electric power source 78 which could be used for other functions in the apparatus 62. The motor rotation is controlled by a timer 80 and started by a switch 82 whose operating lever 84 is in the path of movement of the carrier 60 as it rises. The contact extension 41 is in engagement with a wiper 86 connected by the lead 22 to the d.c. voltage source 78.

The operation of the apparatus 62 is as follows: The image from the optical system 64 is focussed on the surface 48 either during charging by the wire 66 or directly thereafter. When a potential of charge which is measured by a suitable instrument has been reached, the light image is cut off by means of a blinder member 88 which blocks off the optical system 64 and leaves the film 44 in darkness. Immediately thereafter the carrier 60 rises and brings the member 42 into engagement with the front surface of the capsule 10. When perfect alignment of the perforated area 34 and the film 44 has been achieved, the right-hand side of the carrier 60 moves the lever 84 to close the switch 82. The motor 76 rotates one revolution very quickly, say in one second or less. During this time the cam 72 pushes the pressure pad 70 in and then releases the same. The lateral walls 28 of the capsule collapse (FIG. 5) squeezing toner suspension into the chamber 54 and upon release by the pad 70, the walls recover due to the resilience of the internal spongelike mass 26. This latter action serves to suck the remaining toner suspension back into the interior of the capsule 10 (FIG. 6).

Figure 4:
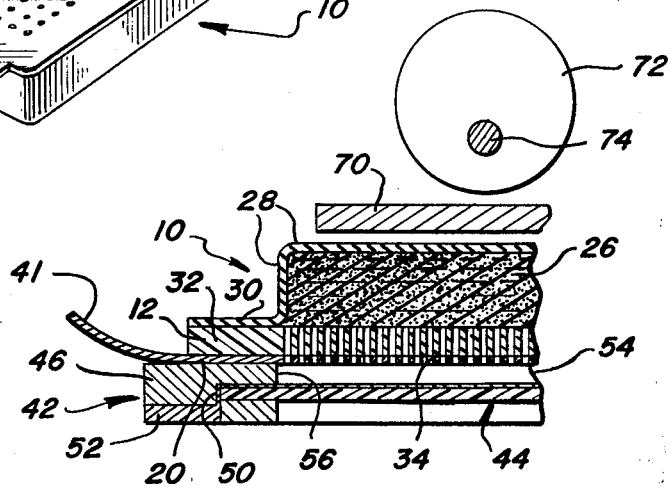
FIG. 4 is a fragmentary sectional view taken through the capsule of FIG. 3, here shown in position for use but before use.
Figure 5:
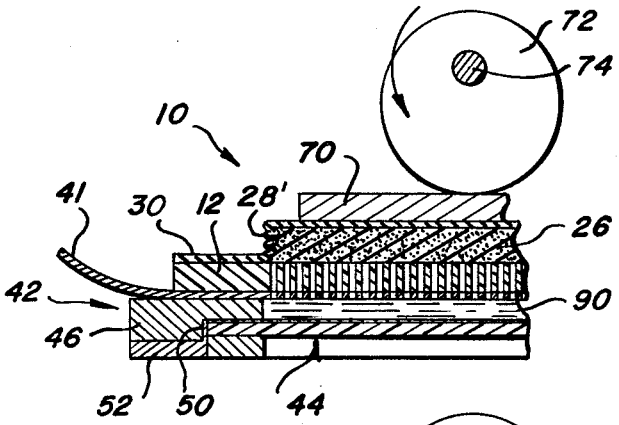
FIG. 5 is a view similar to that of FIG. 4 but showing the manner in which the capsule is used by expressing suspension from the same.
Figure 6:
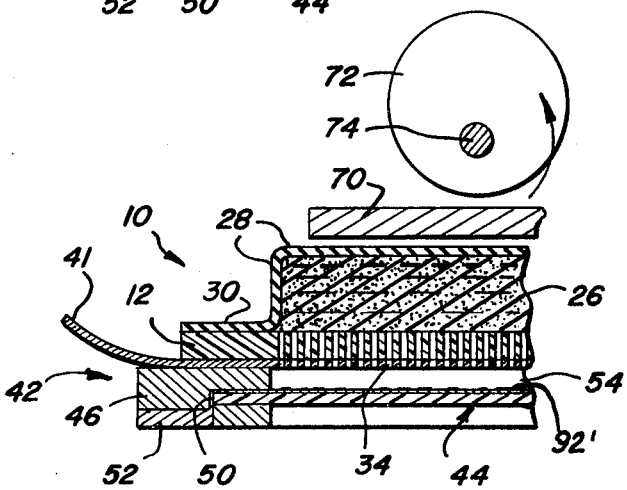
FIG. 6 is a view similar to that of FIGS. 4 and 5 but showing the manner in which the suspension has been sucked back into the capsule leaving toner particles adhered to the electrophotographic film.

FIGS. 4, 5 and 6 show the sequence of events which occur for each revolution of the cam 72. In FIG. 4 the capsule 10 and the member 42 are in place, but nothing has happened. The chamber 54 is empty, the spongelike mass 26 is saturated with the suspension of toner particles in toner liquid, the latent image has been produced on or in the surface of the layer 48, the extension 41 is connected to a source of bias voltage. In FIG. 5 the cam 72 has rotated half way and squeezed the pressure pad 70 against the rear skin or wall 28 of the capsule 10. Now the side walls have collapsed as shown at 28' in FIG. 5 and the toner suspension has been expelled into the chamber 54 substantially filling the same. The suspension is shown at 90 in FIG. 5. The action in the chamber 54 will be explained in detail in connection with FIG. 1 below.

Toner particles now adhere to the surface of the film 44 to render the latent image visible. The cam 72 continues to rotate and the resilience of the spongelike mass 26 causes the walls 28 to recover to the condition shown in FIG. 6. In the process of such recovery, the liquid in the chamber 54 is sucked back into the interior of the capsule 10 through the perforations 14, leaving very little of the suspension in the chamber 54. The spacing between surface 34 and the photoconductive surface 48 is practically capillary in nature and hence the chamber 54 will be quite dry. Additionally, the orientation of the chamber 54 has no adverse effect on the operation. The moisture that does remain will evaporate quickly when the film 44 is exposed to air. The toner particles which adhere are shown at 92' clumped on the surface of the photoconductive coating 48 in accordance with the latent image charge formed thereon.

Thereafter, the film member 42 may be removed and examined and the capsule 10 removed and discarded. Apparatus for fusing the toner will conveniently be provided in the apparatus 62. For another exposure of the same film member 43 or different one, the carrier 60 is lowered to its original position. For additional toning, the capsule 10 must be replaced by a fresh one The apparatus 62 may be varied by having the capsule 10 move to a position in juxtaposition to the film 44 without moving the film, in which case the blinder member 88 may be eliminated and means must be provided to prevent the corona wire 66 from interfering with movement of the capsule 10.

The operation of the apparatus as explained above takes into account what happens during the processing of the film 44. This is probably best explained in connection with FIG. 1.

In FIG. 1 it is assumed that the capsule 10 is being squeezed and the spongelike mass is being compressed. The toner suspension absorbed in the capillaries of the mass 26 comprises minute particles of carbon, resin and the like, either black or colored, in a liquid which has an electrophoretic relationship with the particles. This means that in the suspension, the movement of the particles has caused them to assume a surface charge which they retain when they are expressed from the spongelike mass. In most cases these charges are positive charges, and in order to indicate this, streams of liquid suspension 90 are shown emerging from the perforations 14 carrying irregular shaped particles 92 with positive charges.

The surface 18 of the foraminous member 12 is coated with a very thin layer of metal such as aluminum. This layer is very thin, as would be concluded from an understanding that the thickness of the wall 12 illustrated in FIG. 1 itself is only one millimeter or so. The deposit can be made by vacuum depositing techniques, and is made prior to perforating the wall so that the perforations 14 pass fully and cleanly through the layer 20.

The particles 92 are forced through the passageways represented by the perforations 14 at great speed and directed normal to the surface of the photoconductive layer 48. Since these particles are already charged positively, they will seek out and be attracted to the negatively charged electrons constituting the latent image in the surface of the coating 48. As mentioned, the field represented by these electrons which of course are negatively charged, is weak away from the surface of the coating 48. This causes the edge effect in prior systems of electrostatic processing. The high pressure nozzle effect of the perforations which is illustrated in the chamber 54 in FIG. 1 obviates some of this but in addition, the particles are electrostatically driven directly to the photoconductive surface. The layer 20 is kept at a positive potential of about 50 volts d.c. to provide a bias effect. The effect is not felt while the particle 92 are passing through the perforations 14 because of their force and speed, but does become an important factor when they leave the openings. Since the particles are positively charged and the layer 20 is also positive, the particles 92 are repelled strongly and driven away from the layer and toward the surface of the coating 48. They adhere at the surface to form the visible image, as shown in FIG. 6.

It is to be understood that if the particles require it, they could be charged negatively. Thus, the photoconductive layer 48 might be a p-type layer, with holes produced on its surface by the corona wire instead of electrons. Then the negatively charged particles would adhere to the holes. The image would be a reverse. The bias of layer 20 would then be connected to a negative source of d.c. potential.

Variations in the structure illustrated and described will occur to those skilled in this art. The embodiments herein are only exemplary, the scope of the invention being defined in the claims attached hereto.

What it is desired to secure by Letters Patent of the United States is:

1. A method of toning an electrophotographic film having a photoconductive surface upon which there is a latent image which comprises:

A. providing a liquid suspension of surface charged toner particles within a source container having a floor, a rigid, insulative top wall having a foraminous area on the top wall constituting a delivery face and recoverably deformable side walls, the delivery face spaced from the photoconductive surface, B. flowing the suspension uniformly from said face onto said photoconductive surface substantially simultaneously over the entire area thereof by deforming all said deformable side walls expressing the toner suspension through said delivery face, simultaneously over the foraminous area thereof, C. insitu applying a d.c. electrical bias voltage of a polarity the same as the polarity of the charge carried by the toner particles to the delivery face of the container immediately before so flowing to enhance the particle movement toward said photoconductive surface, whereby the toner particles adhere to the latent image, D. removing any suspension which remains on said photoconductive surface thereafter while maintaining the disposition of said source container and film unchanged by permitting insitu recovery of the deformed container.

2. The method as claimed in claim 1 in which the photoconductive surface is dammed prior to said flowing step to confine the suspension on said surface.

3. The method as claimed in claim 1 in which the flow is normal to the photoconductive surface.

4. A method of toning an electrophotographic film having a photoconductive surface upon which there is a latent image which comprises:

A. providing a liquid suspension of surface charge carrying toner particles in a source container having a floor, a rigid insulative top wall having a foraminous area and flexible recoverably deformable side walls, B. juxtaposing the rigid wall of the container to a space a capillary dimensioned distance from said photoconductive surface, C. forcing streams of said suspension perpendicularly and uniformly against said photoconductive surface substantially simultaneously over all of said photoconductive surface while said rigid top wall is so positioned and through said foraminous area of said rigid top wall by reversably deforming all the flexible side walls of said container whereby the toner particles adhere to the latent image, and D. effecting insitu recovery of said container thereby removing any excess suspension which remains on said photoconductive surface thereafter.

5. A method as claimed in claim 4 and applying an electrical bias to said container during delivery of said toner particles therefrom to enchance movement of said toner particles to said surface.

6. A method as claimed in claim 4 and confining the toner suspension on said photoconductive surface by damming the photoconductive surface during expression of the toner suspension from said container.

* * * * *